US005850974A

United States Patent [19]

Kettl et al.

[11] Patent Number: 5,850,974

[45] Date of Patent: Dec. 22, 1998

[54] DEVICE TO PRODUCE AN ADJUSTABLE FLUID JET

[75] Inventors: Werner Kettl, Neusäss; Josef Ottl, Diedorf, both of Germany

[73] Assignee: Grafotec GmbH, Diedorf, Germany

[21] Appl. No.: 843,284

[22] Filed: Apr. 14, 1997

[30] Foreign Application Priority Data

May 2, 1996 [DE] Germany ..... 196 17 479.1

[51] Int. Cl.[6] ..... B05B 15/00

[52] U.S. Cl. ..... 239/546; 239/602

[58] Field of Search ..... 239/583, 602, 239/533.13, 546

[56] References Cited

U.S. PATENT DOCUMENTS

| | | | |
|---|---|---|---|
| 2,793,080 | 5/1957 | Brown | 239/602 X |
| 3,291,396 | 12/1966 | Walter | 239/602 X |
| 3,550,861 | 12/1970 | Teson | 239/602 X |
| 3,711,020 | 1/1973 | Zelna | 239/602 X |

FOREIGN PATENT DOCUMENTS

| | | | |
|---|---|---|---|
| 556121 | 8/1993 | European Pat. Off. | 239/602 |

*Primary Examiner*—Kevin Weldon
*Attorney, Agent, or Firm*—Harrison & Egbert

[57] ABSTRACT

A control device for an adjustable fluid jet having a piston arrangement with a through bore communicating with at least one through recess of an elastic element. A thrust bolt enters a jet tube arranged in a fixed manner at the jet head. A following control piston limits a pressure chamber supplied with the pressure medium on the other side of the thrust bolt. A sealing plug projects from the opposite end of the thrust bolt and exhibits a smaller diameter and enters in a sealing manner into an opening that departs from the pressure chamber and is supplied with the fluid to be processed.

4 Claims, 1 Drawing Sheet

DEVICE TO PRODUCE AN ADJUSTABLE FLUID JET

TECHNICAL FIELD

The invention concerns a device to produce an adjustable fluid jet, more specifically for the application of adhesive and/or soft fluid onto a sheet, fitted with a nozzle head containing a jet with an orifice arranged at the end of a flow path to be supplied with the fluid to be processed, in which case the orifice area is fitted with an elastic element that exhibits a through recess communicating with the flow path and is arranged between two pressure units that can be adjusted in relation to each other with a control device arranged on the jet holder, i.e., in the form of a jet tube that tapers to the front and receives the elastic element, and of a mating bored thrust bolt.

BACKGROUND ART

An arrangement of this type has been described in U.S. Pat. Ser. No. 08/574 302. In that arrangement, the jet tube is mobile and the mating thrust bolt is stationary. Accordingly, this arrangement is relatively more expensive and requires more components to activate the mobile jet tube.

Based on the above, the objective of this invention consists of improving a device of the above-mentioned type with simple and less expensive means and in such a manner that the control device is a relatively simple unit.

SUMMARY OF THE INVENTION

In accordance with the invention, this objective is achieved by providing a piston arrangement that is fitted with a continuous bore communicating with at least one of the through recesses of the elastic element and that consists of a thrust bolt that enters the jet tube arranged in a fixed manner at the jet head, of a connecting control piston that limits the pressure chamber to be supplied with a pressure medium on the other side of the thrust bolt, and of a sealing plug that projects from the opposite side of the thrust bolt, exhibits a smaller diameter and enters in a sealing manner into the jet head bore that departs from the pressure chamber and is to be supplied with the fluid to be processed.

In an advantageous manner, these measures yield fewer components and still ensure a reliable sealing effect in the flow path used by the fluid to be processed. Accordingly, it is possible to achieve a cost-effective manufacturing process and the device requires little maintenance.

Advantageous developments and appropriate further designs of the main features are described in the sub-claims and are explained in the following description of an example with the help of the drawing.

BRIEF DESCRIPTION OF THE DRAWINGS

The drawing shows a partial section through a jet head in accordance with the invention.

The basic design and the basic operating principle of this presented arrangement correspond to the arrangement described in the U.S. patent application Ser. No. 08/574 302, in which case reference will be made to it to avoid repetitions. Accordingly, the following description will mainly emphasize the differences, in which case the same numbers are given to the same components.

Figure 1:
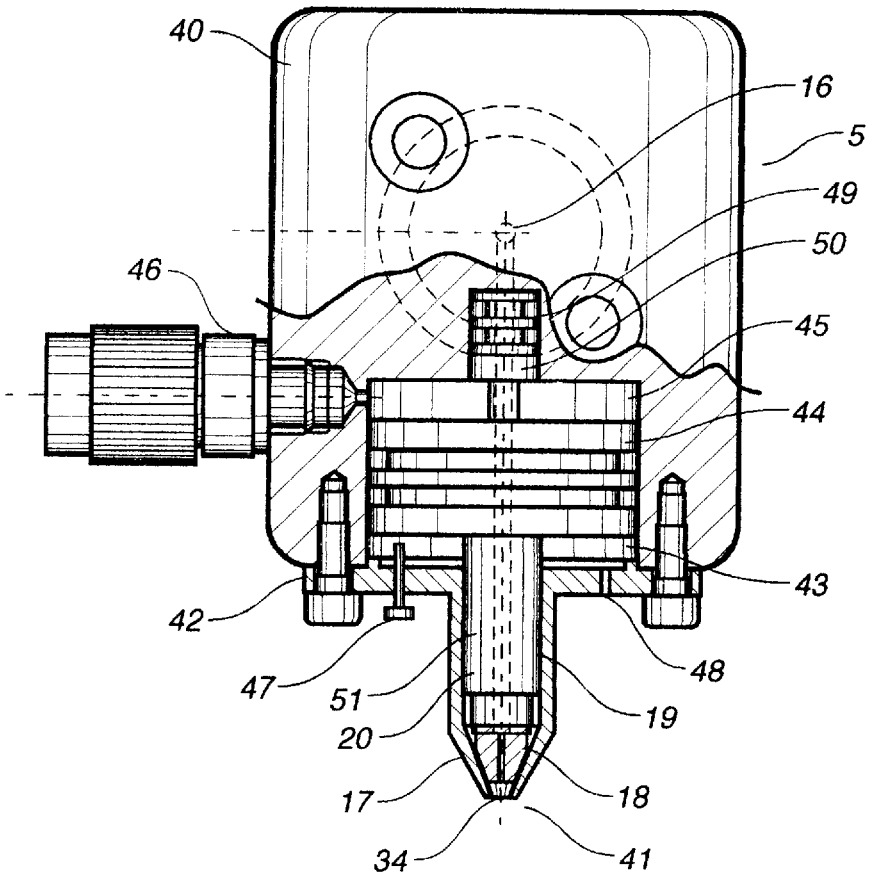

Jet head 5 shown here comprises of housing block 40, to which is connected jet 41 by way of a flange. Said jet is fitted with jet tube 19, whose front end is tapered, has a front opening 34 and is attached to rear flange 42 that is attached to housing block 40 with bolts.

Cylinder chamber 43 arranged in housing block 40 is adjacent to the bore of jet tube 19. It has a larger diameter than the bore of jet tube 19 and is closed outside of it with flange 42.

The front area of jet tube 19 is fitted with an elastic element 18 that by way of a formed cone enters the tapered area of jet tube 19 and exhibits a central through recess 17 that ends in the area of front opening 34 of jet tube 19 and is connected to supply pipe 16 for the fluid to be processed, such as an adhesive or soft fluid to be applied in the form of a jet to a substratum such as a moving paper sheet. To adjust the jet diameter and thus the quantity, elastic element 18 is compressed to varying degrees, thus changing the clear width of its through recess 17.

To that effect, elastic element 18 arranged in and supported by the fixed jet pipe 19 is by way of thrust bolt 20 entering jet tube 19 pressed to varying degrees against the respective support surface of jet tube 19. Thrust bolt 20 is operated through a control unit arranged in housing block 40.

To that effect, cylinder chamber 43 contains control piston 44, from which thrust bolt 20 with a smaller diameter projects downward and limits pressure chamber 45 that is located on the opposite side of thrust bolt 20 and can be supplied with a pressure medium such as compressed air through supply connection 46. The pressure applied by the pressure medium is adjustable to control the compression of elastic element 18. The maximum control movement of control piston 44 is limited by a stop. To obtain said effect, flange 42 can be fitted with a threaded bore which can receive set screw 47 functioning as an adjustable stop. Flange 42 can also be fitted with a venting opening 48.

From pressure chamber 45 formed by the upper area of cylinder chamber 43 originates blind hole 49 projecting upward, into which enters supply pipe 16 carrying the fluid to be processed. Sealing plug 50 located at the opposite end of thrust bolt 20 and adjacent to control piston 44 penetrates blind hole 49. 0-rings are used to seal it against the wall of blind hole 49. Control piston 44 is also sealed with 0-rings against the wall of the respective cylinder chamber 43.

Control piston 44 as well as the adjacent thrust bolt 20 and sealing plug 50 form a piston arrangement in the form of a step piston. This whole piston arrangement is fitted with a central through bore 51, to which is connected through recess 17 of elastic element 18, thus connecting through recess 17 of elastic element 18 with supply line 16. The penetration depth of sealing plug 50 into blind hole 49 is longer than the maximum adjustment distance of control piston 44 and sealing plug 50 therefore always remains engaged in blind hole 49, thus reliably sealing pressure chamber 45 with respect to supply pipe 16 that delivers the fluid to be processed. Said fluid is independent of the position of control piston 44 supplied through the central through recess 51 to the central through recess 17 of elastic element 18.

We claim:

1. A device for producing an adjustable fluid jet, for an application of a fluid onto a substratum, the device being fitted with a jet head carrying a jet having an opening at one end of a flow path to be supplied with the fluid, the opening is fitted with an elastic element having a through recess connected to the flow path, the elastic element is positioned between a jet tube and a mating thrust bolt that are adjustable in relation to each other, a control device arranged on the jet head, the jet tube tapers toward an end and receives the elastic element, the control device comprising a piston arrangement with a through bore communicating with the through recess of the elastic elements, said thrust bolt entering the jet tube in a fixed manner at the jet head, a following control piston that is controlled by pressure from a pressure chamber, the pressure chamber is supplied with a pressure medium on an opposite side of the control piston from the thrust bolt, and a sealing plug that projects from an opposite side of the thrust bolt, said sealing plug being in a sealing relationship with an opening that communicates with the pressure chamber and is supplied with the fluid, said sealing plug having a smaller diameter than said opening, said jet tube comprising a flange sealing a cylinder chamber within the jet head, said cylinder chamber receiving said control piston therein.

2. The device in accordance with claim 1, wherein the jet tube comprises a tapered section into which the elastic element is positioned, said elastic element having an integral conical area in mating relation with said tapered section.

3. The device in accordance with claim 1, wherein the diameter of the control piston is greater than a diameter of the thrust bolt and of the diameter of the sealing plug.

4. The device in accordance with claim 1, wherein a diameter of the control piston is greater than the diameter of the thrust bolt and of the diameter of the sealing plug.

* * * * *